US009381135B2

(12) United States Patent
Reynolds et al.

(10) Patent No.: US 9,381,135 B2
(45) Date of Patent: Jul. 5, 2016

(54) EASY LINKING TRANSFER SYSTEM

(75) Inventors: David L. Reynolds, Bromont (CA); Daniel MacDonald, Bromont (CA); Yan Tremblay, Orford (CA); Eric Geoffroy, Ayer's Cliff (CA)

(73) Assignee: Duoject Medical Systems Inc., Bromont, Quebec (CA)

( * ) Notice: Subject to any disclaimer, the term of this patent is extended or adjusted under 35 U.S.C. 154(b) by 283 days.

(21) Appl. No.: 13/261,729

(22) PCT Filed: Mar. 5, 2012

(86) PCT No.: PCT/CA2012/000190

§ 371 (c)(1),
(2), (4) Date: Aug. 30, 2013

(87) PCT Pub. No.: WO2012/119225

PCT Pub. Date: Sep. 13, 2012

(65) Prior Publication Data

US 2014/0000738 A1 Jan. 2, 2014

(30) Foreign Application Priority Data

Mar. 4, 2011 (CA) ..... 2733446
Jul. 6, 2011 (CA) ..... 2746031

(51) Int. Cl.
*A61J 1/20* (2006.01)

(52) U.S. Cl.
CPC *A61J 1/20* (2013.01); *A61J 1/2096* (2013.01); *A61J 1/201* (2015.05); *Y10T 137/9029* (2015.04)

(58) Field of Classification Search
CPC ..... A61J 1/14; A61J 1/2096; B65B 1/04
USPC ..... 141/27, 311 R, 312, 318, 319, 321, 322, 141/326, 329, 330, 346, 351, 352, 353, 357, 141/369, 370, 372, 383, 384, 385, 386; 604/87, 88, 89, 411, 414, 415
See application file for complete search history.

(56) References Cited

U.S. PATENT DOCUMENTS 3,047,178 A * 7/1962 Poitras ..... A61J 1/2089 215/249
4,564,054 A * 1/1986 Gustavsson ..... A61J 1/2096 141/329
4,673,404 A * 6/1987 Gustavsson ..... A61J 1/2096 604/411
5,158,554 A * 10/1992 Jepson ..... A61J 1/2089 604/411
5,171,214 A * 12/1992 Kolber ..... A61J 1/2096 206/222
5,429,614 A * 7/1995 Fowles ..... A61J 1/2089 604/201
5,526,853 A * 6/1996 McPhee ..... A61J 1/2089 141/114
5,647,845 A * 7/1997 Haber ..... A61J 1/10 604/32
5,827,262 A * 10/1998 Neftel ..... A61J 1/2096 604/414
6,149,623 A * 11/2000 Reynolds ..... A61J 13/0203 604/187
6,209,738 B1 * 4/2001 Jansen ..... A61J 1/1406 141/329
6,238,372 B1 * 5/2001 Zinger ..... A61J 1/2089 604/246

(Continued)

*Primary Examiner* — Mark A Laurenzi
*Assistant Examiner* — Andrew Schmid
(74) *Attorney, Agent, or Firm* — Eric Fincham

(57) ABSTRACT

A transfer device for pharmaceuticals comprising a housing which has an open bottom permitting insertion of a vial within the housing, a piercing member mounted within the housing and having an interior passageway formed therein, a connector for a syringe located on top of the housing, and a moveable member mounted within the housing, the moveable member being moveable from a first position preventing access to the piercing member and a second position permitting access to the piercing member when the vial is inserted in the housing.

6 Claims, 9 Drawing Sheets

(56) References Cited

U.S. PATENT DOCUMENTS 6,280,430 B1 * 8/2001 Neftel ..... A61J 1/2096 604/411
6,378,714 B1 * 4/2002 Jansen ..... A61J 1/1406 141/329
6,478,788 B1 * 11/2002 Aneas ..... A61J 1/2089 215/247
6,746,438 B1 * 6/2004 Arnissolle ..... A61J 1/062 604/411
6,796,967 B2 * 9/2004 Jensen ..... A61M 5/3202 604/192
6,890,328 B2 * 5/2005 Fowles ..... A61J 1/10 604/413
7,354,427 B2 * 4/2008 Fangrow ..... A61J 1/2089 222/386.5
7,992,597 B2 * 8/2011 Py ..... A61J 1/1406 141/11
8,002,130 B2 * 8/2011 Thilly ..... B65B 3/003 215/249
8,096,525 B2 * 1/2012 Ryan ..... A61M 39/26 251/149.6
8,167,863 B2 * 5/2012 Yow ..... A61J 1/2096 604/406
8,196,614 B2 * 6/2012 Kriheli ..... A61J 1/2096 141/290
8,211,082 B2 * 7/2012 Hasegawa ..... A61J 1/2096 604/411
8,225,949 B2 * 7/2012 Aneas ..... B65D 51/002 215/249
8,277,424 B2 * 10/2012 Pan ..... A61M 39/26 604/249
2002/0177819 A1 * 11/2002 Barker ..... A61M 5/3234 604/232
2003/0153895 A1 * 8/2003 Leinsing ..... A61J 1/2089 604/403
2006/0155257 A1 * 7/2006 Reynolds ..... A61J 1/2096 604/414
2006/0184103 A1 * 8/2006 Paproski ..... A61J 1/2096 604/86
2007/0078428 A1 * 4/2007 Reynolds ..... A61J 1/2096 604/411
2007/0079894 A1 * 4/2007 Kraus ..... A61J 1/2089 141/319
2008/0009789 A1 * 1/2008 Zinger ..... A61J 1/2096 604/89
2008/0172001 A1 * 7/2008 Reynolds ..... A61J 1/2089 604/232
2008/0177244 A1 * 7/2008 Capitaine ..... A61J 1/2089 604/414
2008/0249479 A1 * 10/2008 Zinger ..... A61J 1/2096 604/244
2008/0262466 A1 * 10/2008 Smith ..... A61J 1/05 604/415
2008/0306439 A1 * 12/2008 Nelson ..... A61J 1/2096 604/84
2009/0069783 A1 * 3/2009 Ellstrom ..... A61M 39/1011 604/415
2009/0137979 A1 * 5/2009 Adair ..... A61M 5/1452 604/411
2010/0168712 A1 * 7/2010 Tuckwell ..... A61J 1/2096 604/406
2010/0241088 A1 * 9/2010 Ranalletta ..... A61J 1/2089 604/264
2011/0004183 A1 * 1/2011 Carrez ..... A61J 1/2096 604/405
2011/0022023 A1 * 1/2011 Weitzel ..... A61J 1/1412 604/414
2011/0106021 A1 * 5/2011 Ruegg ..... A61K 8/64 604/290
2011/0208128 A1 * 8/2011 Wu ..... A61J 1/2096 604/247
2012/0053554 A1 * 3/2012 Simpson ..... A61J 1/1406 604/411
2012/0296307 A1 * 11/2012 Holt ..... A61J 1/2089 604/407
2012/0323172 A1 * 12/2012 Lev ..... A61J 1/2096 604/87
2013/0076019 A1 * 3/2013 Takemoto ..... A61J 1/2096 285/117
2013/0184672 A1 * 7/2013 Nord ..... A61J 1/2096 604/414
2014/0000738 A1 * 1/2014 Reynolds ..... A61J 1/2096 137/798
2014/0150925 A1 * 6/2014 Sjogren ..... A61J 1/2096 141/94
2014/0276649 A1 * 9/2014 Ivosevic ..... A61J 1/2096 604/533
2014/0311624 A1 * 10/2014 Eilertsen ..... A61J 1/2096 141/18
2014/0360623 A1 * 12/2014 Nielsen ..... A61J 1/2096 141/27
2015/0082746 A1 * 3/2015 Ivosevic ..... B65B 69/0041 53/381.1
2015/0101706 A1 * 4/2015 Fukuoka ..... A61J 1/2096 141/27
2015/0126974 A1 * 5/2015 Sanders ..... A61J 1/2096 604/533
2015/0209230 A1 * 7/2015 Lev ..... A61J 1/1406 604/414

* cited by examiner

EASY LINKING TRANSFER SYSTEM

FIELD OF THE INVENTION

The present invention relates to a transfer system and more particularly, relates to an assembly for transferring one or more components of a pharmaceutical composition between containers.

BACKGROUND OF THE INVENTION

Typically, a syringe is, filled manually by aspirating a liquid pharmaceutical component from a pharmaceutical vial which traditionally has a penetrable closure. The syringe has a needle that penetrates the penetrable closure following which the syringe is typically filled by drawing air into the body of the syringe, aligning the needle with the vial's penetrable closure and inserting the needle through the penetrable closure into the vial. Subsequently, the vial is inverted and air is forced from the body of the syringe into the vial. The plunger is then withdrawn to draw out the desired volume of the pharmaceutical component into the syringe and the needle is removed from the vial.

Many pharmaceutical preparations must be distributed and sold as two or more separate components—typically a solid component and a liquid component. They are mixed just prior to administration. In some instances, the two or more components may each be liquid and require mixing prior to administration to the patient.

SUMMARY OF THE INVENTION

It is an object of the present invention to provide an assembly for transferring the contents of a first container to a second container.

According to one aspect of the present invention, there is provided a transfer device comprising a housing having a top, a side wall, an open bottom, the open bottom permitting insertion of a vial within the housing, a piercing member mounted within the housing, the piercing member having a piercing tip located at a bottom end thereof, the piercing member having an interior passageway formed therein, a connector located on an exterior side of the top, a moveable member mounted within the housing, the moveable member being moveable from a first position wherein the moveable member prevents access to the piercing tip and a second position permitting access to the piercing tip when the vial is inserted in the housing.

In a large number of cases, the transfer device of the present invention provides for the easy linking of a vial and a syringe whereby the components may be mixed to form a composition in the syringe ready for patient injection.

The contents of the vial may be any suitable pharmaceutical component though in many instances, it will be a dry pharmaceutical component such as a lyophilized product. However, as previously mentioned, it could also be a liquid component.

The syringe will normally contain a liquid component which is frequently a diluent for the active pharmaceutical ingredient in the vial. The syringe may be any conventional syringe readily available from different manufacturers. Typically, the syringe will contain a piston and have a back stop or finger flange attached to one end thereof. A plunger rod will be attachable to the piston of the syringe.

One problem with known transfer devices is that access to the needle or plastic spike within the transfer device should be minimized to prevent accidental pricks. Once such transfer device is shown in International Application PCT/CA2010/001399, the teachings of which are incorporated herein by reference. In the transfer device, a cap is provided to permit access to the syringe side of the device and the luer connection cannot be accessed until the cap is removed. However, the cap can only be removed when the device is coupled to the vial.

On some occasions, it is deemed desirable to re-use the transfer device. With the aforementioned transfer device, this was not possible as the vial remains secured to the transfer device and both are disposed of as a unit.

On other occasions, it is deemed best practise to not permit re-use of the transfer device due to possible contamination. However, it is still desirable to protect the user from the needle or spike.

In one embodiment of the present invention wherein the device may not be re-used, the moveable member engages the wall of the housing upon upward movement when the vial is inserted into the housing. The rotational movement moves it to an upper position which, when the vial is pulled down, the moveable member moves to a position where it still protects against accidental needle prick but also cannot be moved upwardly again as it is locked position.

In a further embodiment, the moveable member is retracted down to a position from which it started to enable re-use of the transfer device.

BRIEF DESCRIPTION OF THE DRAWINGS

Having thus generally described the invention, reference will be made to the accompanying drawings illustrating an embodiment thereof, in which.

DETAILED DESCRIPTION OF THE INVENTION

Figure 1:
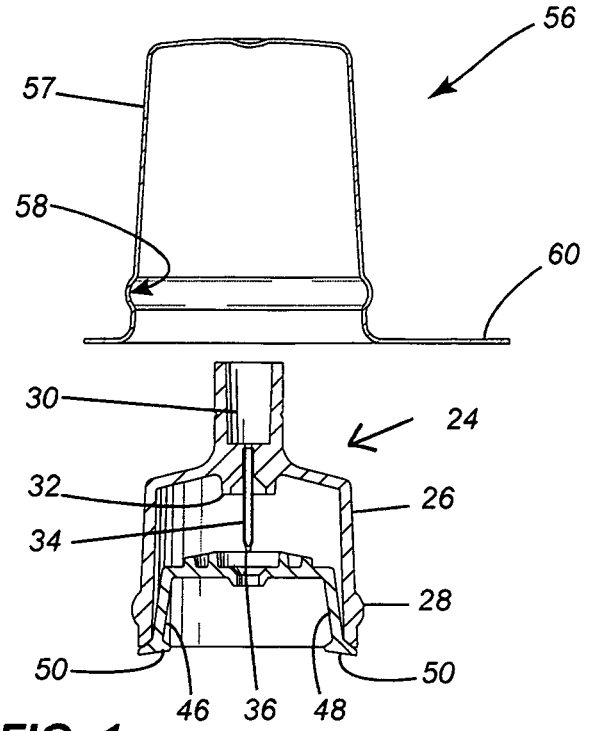
FIG. 1 is a side elevational view of a transfer device according to the present invention.
Figure 2:
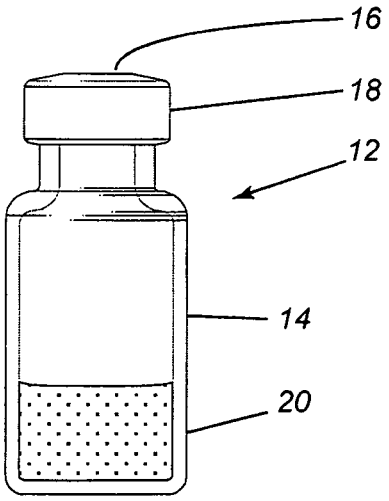
FIG. 2 is a side elevational view, partially in section, of a vial containing a medicant.
Figure 3:
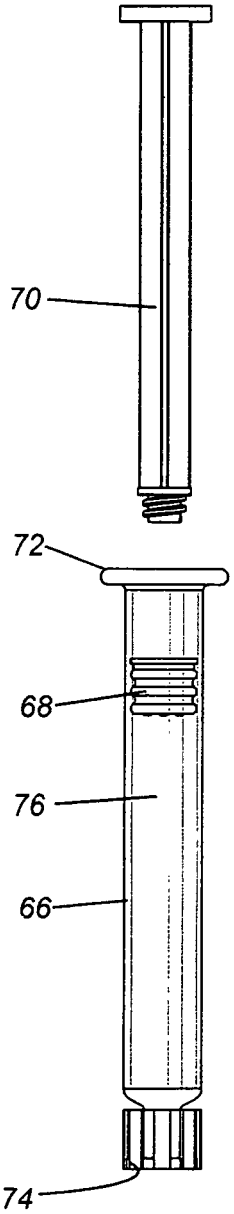
FIG. 3 is a side elevational view of a syringe and plunger rod.
Figure 4:
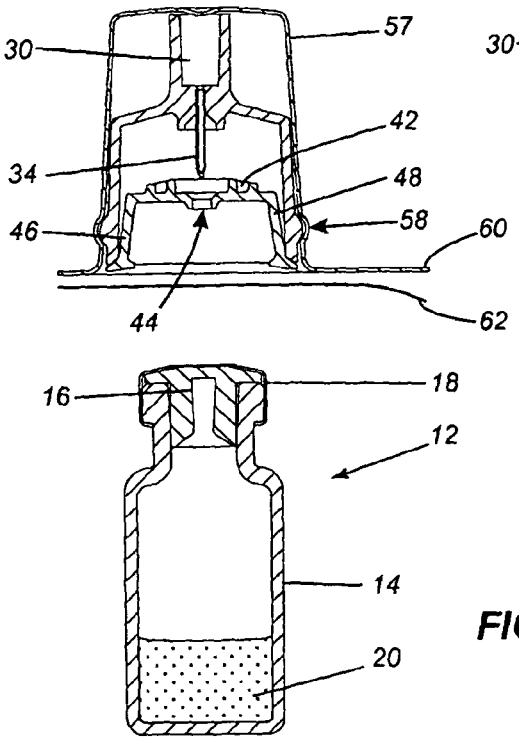
FIG. 4 is a cross sectional view of the transfer device prior to its use.
Figure 5:
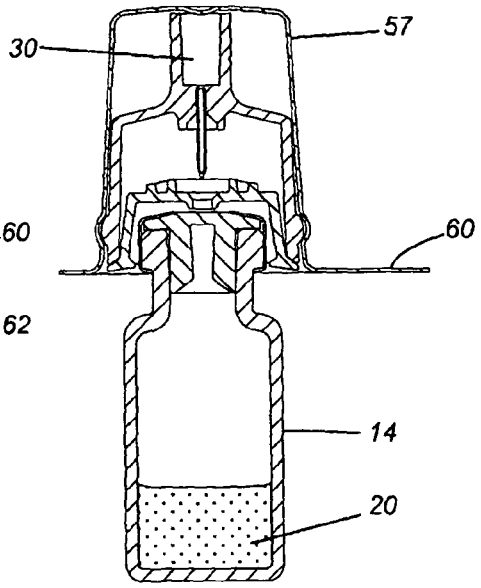
FIG. 5 is a side sectional view of the device being placed on a vial.
Figure 6:
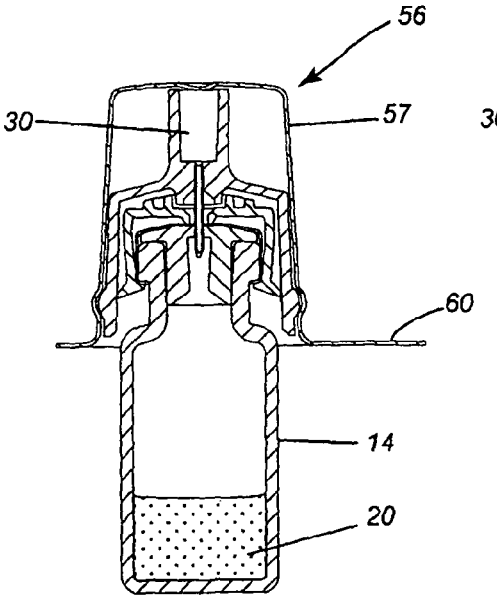
FIG. 6 is a side sectional view showing piercing of the vial.
Figure 7:
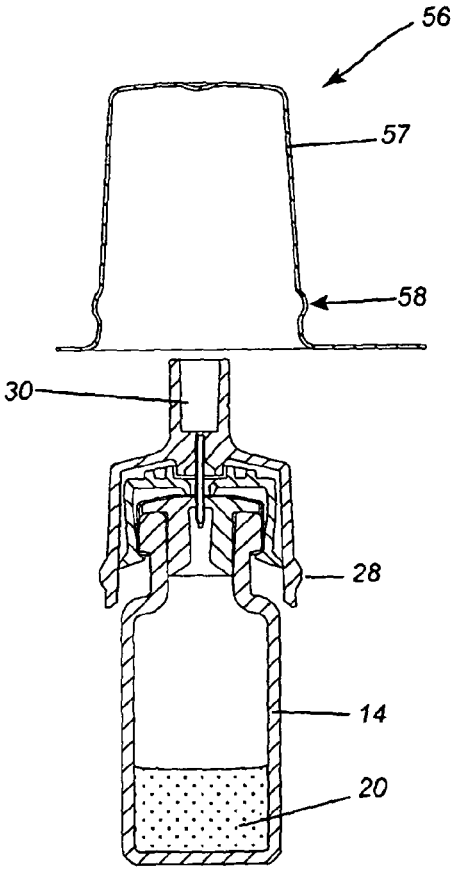
FIG. 7 is a cross sectional view illustrating the cap being removed.

Referring to the drawings in greater detail and by reference characters thereto, there is illustrated a transfer system which is generally designated by reference numeral 10 and which is suitable for use with a vial generally designated by reference numeral 12.

Vial 12 has a body 14 with a neck sealed by a septum 16 over which there is a cap 18. A medicant 20 is contained within body 14 and would typically comprise a dry ingredient although a fluid may also be utilized.

Transfer system 10 includes an outer housing 24 and a circular side wall 26. On circular side wall 26 there is a protrusion 28 near the bottom thereof. On its upper end, there is provided a luer connection 30. An inner wall 32 mounts a needle 34 which is hollow in nature and has a piercing end 36. As previously mentioned, needle 34 may be a spike.

Mounted interiorly of outer housing 24 is a moveable member 40. Moveable member 40 has a top wall 42 with an aperture 44 centrally located therein to permit the passage of needle 34. Extending downwardly from top wall 42 is a first leg 46 and a second leg 48. First leg 46 has an outwardly extending flange 50 at the bottom thereof while second leg 48 also has an outwardly extending flange 52.

A cover 56 is provided to receive transfer system 10. Cover 56 has a side wall 57 with a groove 58 which is adapted to engage with protrusion 28 to retain transfer system 10 in position. Side wall 57 is provided with an outwardly extending flange 60 at the bottom thereof. Flange 60 is designed to receive a peelable sealing strip 62 so as to provide a hermetically sealed package.

The transfer system of the present invention is preferably utilized with a syringe which has a syringe body 66 and a plunger 68 mounted therein. A plunger rod 70 is designed to be screwthreadably engageable with plunger 68. Syringe body 66 includes a backstop 72 to permit proper gripping by the hand of a user. At its front end, syringe body 68 includes a luer connector 74. Typically, syringe body 66 is filled with a diluent 76 although any desired fluid may be utilized.

Figure 8:
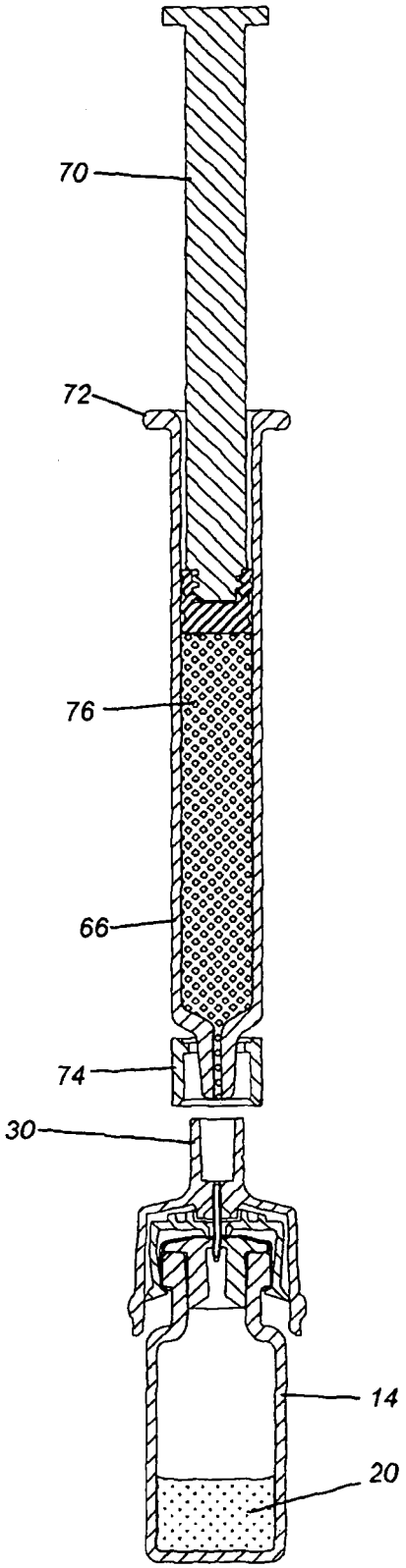
FIG. 8 is a view, partially in cross section, of a syringe being attached to the transfer device.
Figure 9:
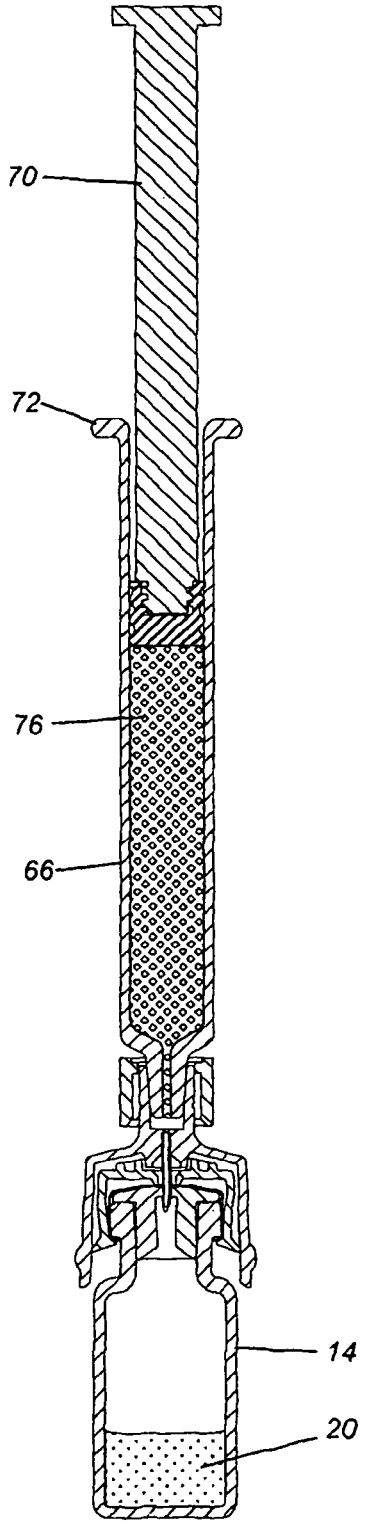
FIG. 9 is a cross sectional view illustrating a syringe being ready to be placed on the vial.
Figure 10:
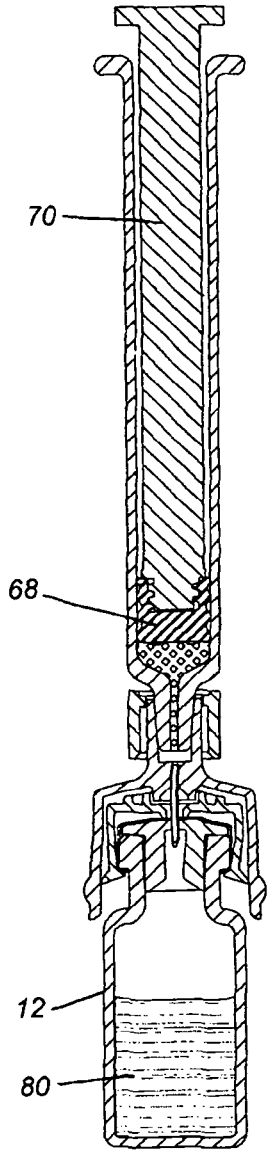
FIG. 10 is a cross sectional view illustrating the syringe attached to the vial.
Figure 11:
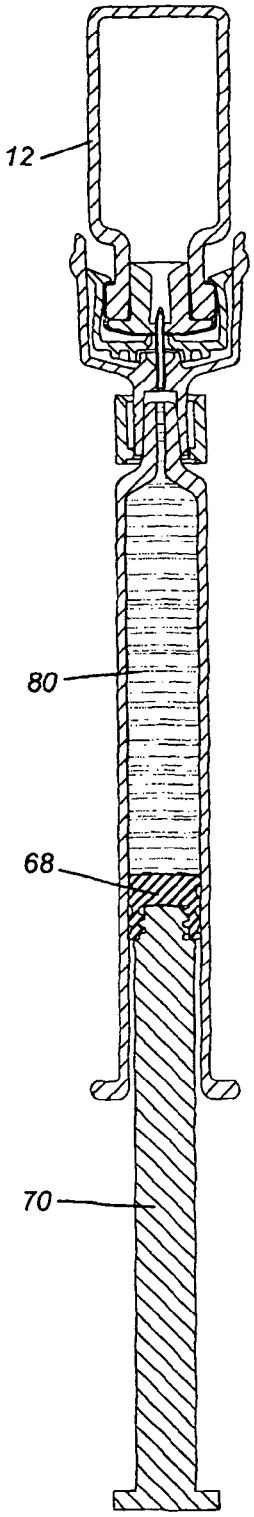
FIG. 11 is a sectional view illustrating the mixing of components.
Figure 12:
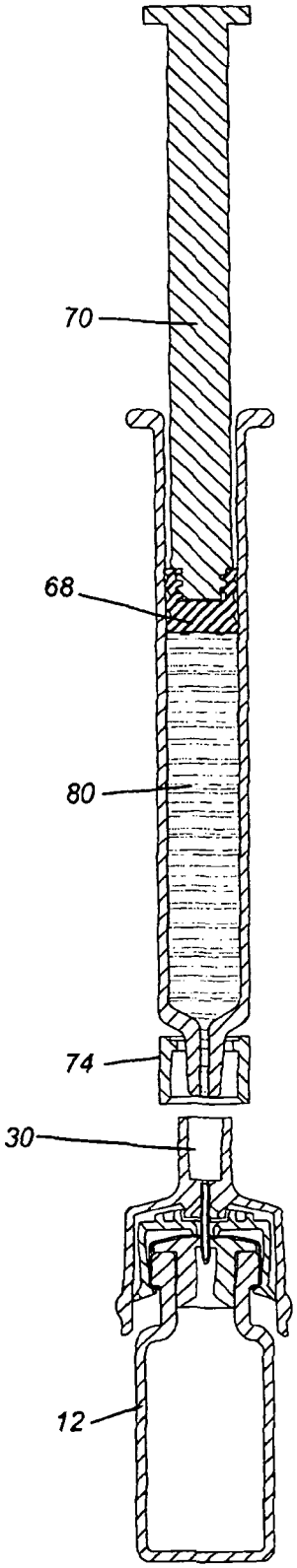
FIG. 12 is a sectional view illustrating the aspiration of the mixture into the syringe
Figure 13:
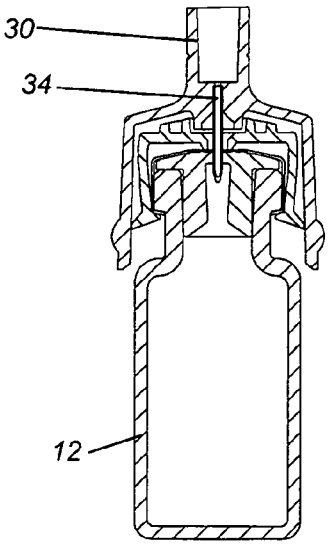
FIG. 13 is a cross sectional view illustrating placement of the transfer assembly on a vial.
Figure 14:
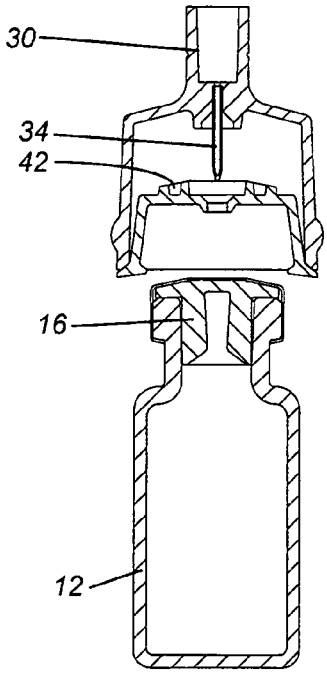
FIG. 14 is an exploded view illustrating the transfer assembly and the vial prior to insertion of the vial.
Figure 15A:
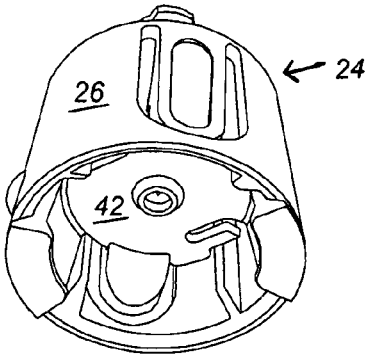
FIG. 15A is a bottom perspective view of a transfer assembly according to one embodiment of the present invention.
Figure 16A:
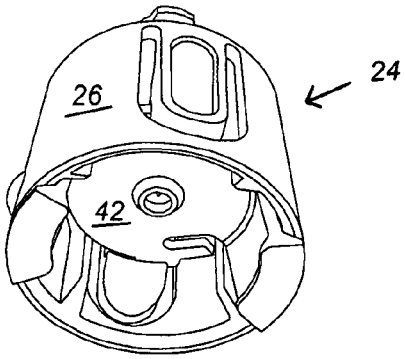
FIG. 16A is a perspective view of the transfer assembly according to a further embodiment.
Figure 15B:
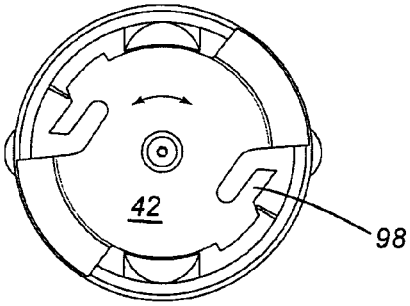
FIG. 15B is a bottom plan view thereof.
Figure 16B:
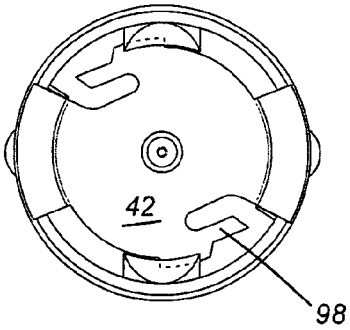
FIG. 16B is a bottom plan view thereof.
Figure 17A:
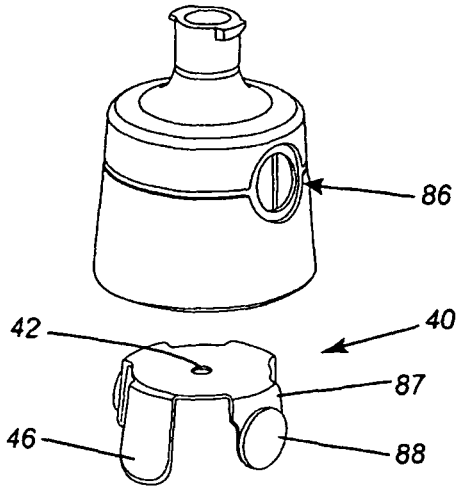
FIG. 17A is an exploded view of the transfer assembly.
Figure 17B:
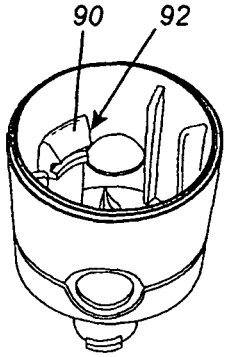
FIG. 17B is a bottom perspective view thereof.
Figure 17C:
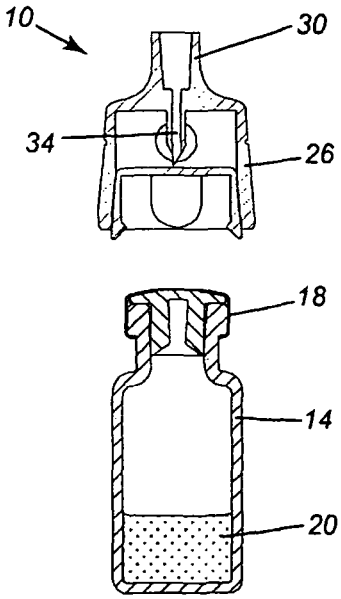
FIGS. 17C to 17E show the sequence of placing the transfer assembly on the vial.
Figure 17D:
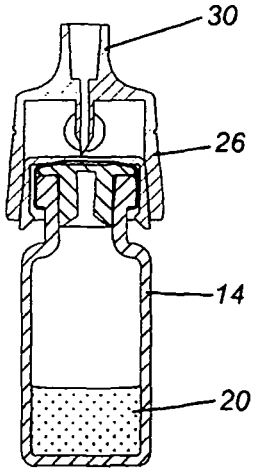
Figure 17E:
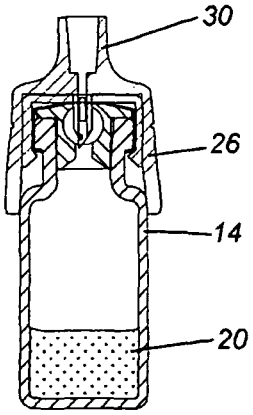
Figure 17F:
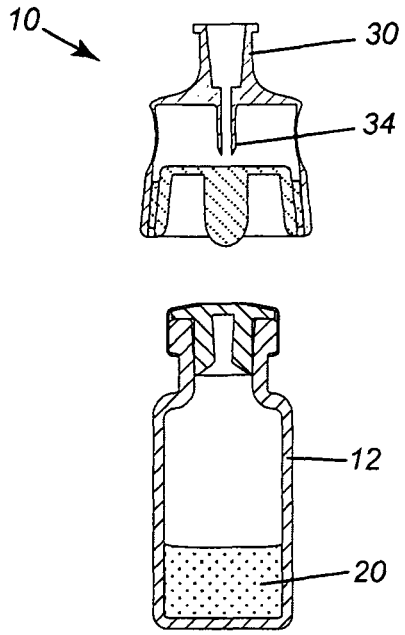
FIGS. 17F to 17H illustrate the placement of the transfer assembly in a further embodiment thereof on a vial.
Figure 17G:
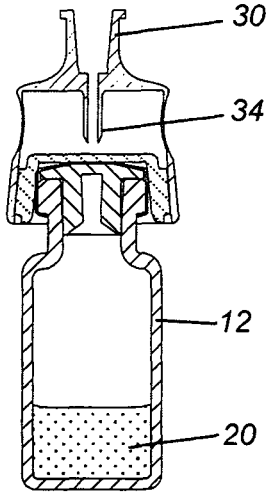
Figure 17H:
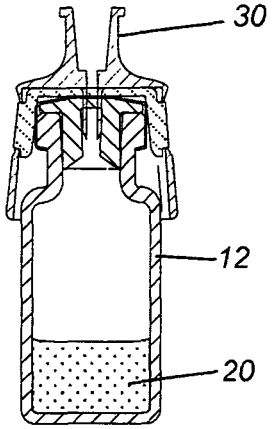

As shown in FIGS. 8 and 9, plunger rod 70 is connected to plunger 68 and the diluent 76 is then forced into vial body 14 as shown in FIG. 10. The medicant and diluent may then be mixed and the assembly inverted as shown in FIG. 11. The mixture 80 is then aspirated back into syringe body 66. The mixture 80 is then ready for injection when a needle assembly is connected to luer connector 74.

In the embodiment of FIGS. 17A to 17H, it will be noted that outer housing 24 is provided with a pair of apertures 86 in side wall 26. Also, in this embodiment, there are provided an extra pair of legs 87 each having buttons 88 formed on an exterior surface thereof. In this embodiment, when the moveable member 40 moves upwardly, buttons 88 engage in apertures 86.

On the interior surface of wall 26, there are provided ribs 90 which have a groove 92 formed therein. Thus, when pressure is exerted on buttons 86 as vial 12 is being withdrawn, moveable member 40 will move downwardly until the top wall 42 engages with groove 92. This retains moveable member 40 in position for further use.

Figure 18:
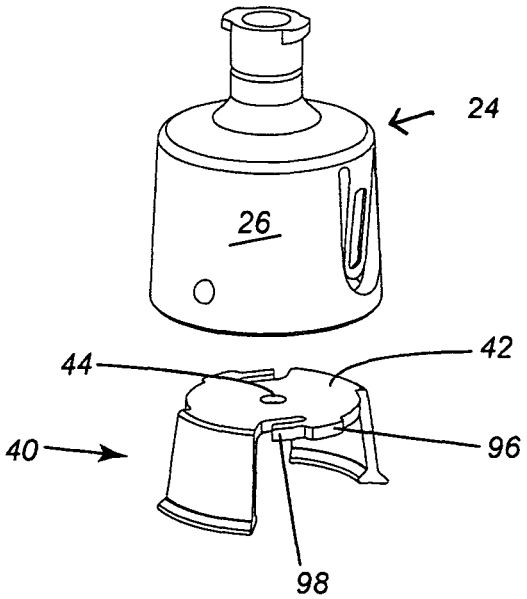
FIG. 18 is an exploded view of the transfer assembly.
Figure 19A:
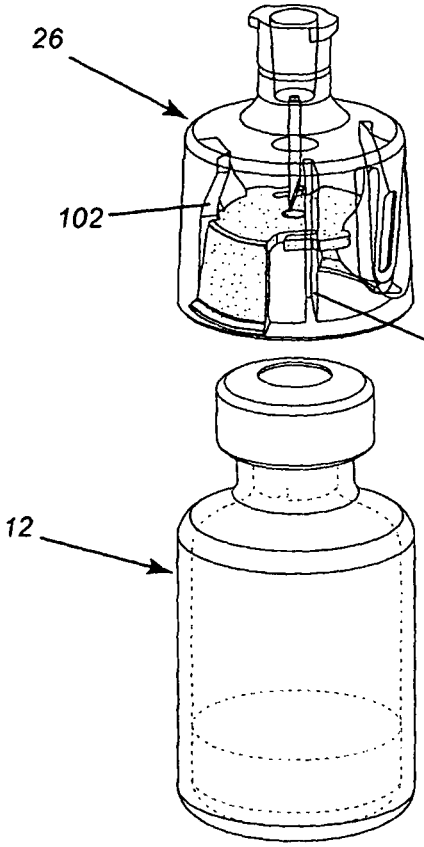
FIGS. 19A to 19D are perspective views illustrating placement of the transfer assembly on a vial and removal thereof.
Figure 19B:
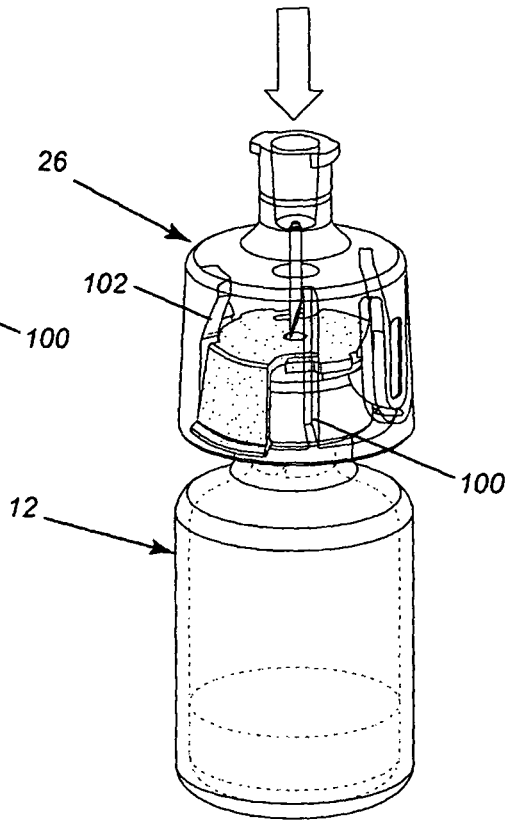
Figure 19C:
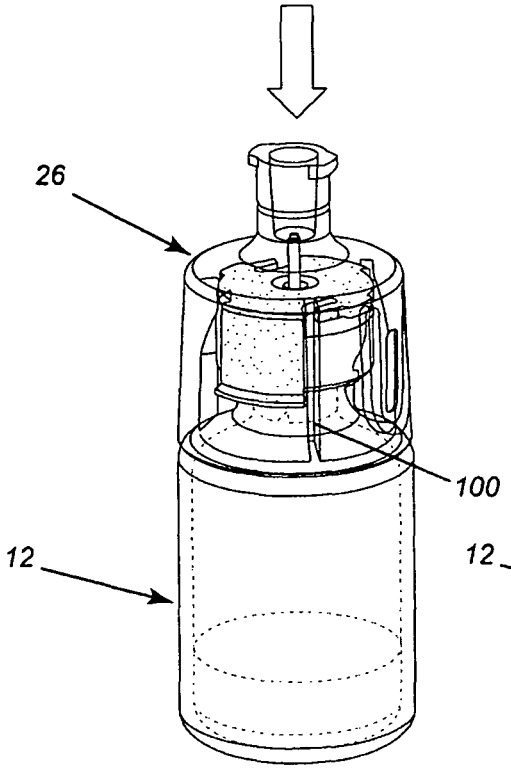
Figure 19D:
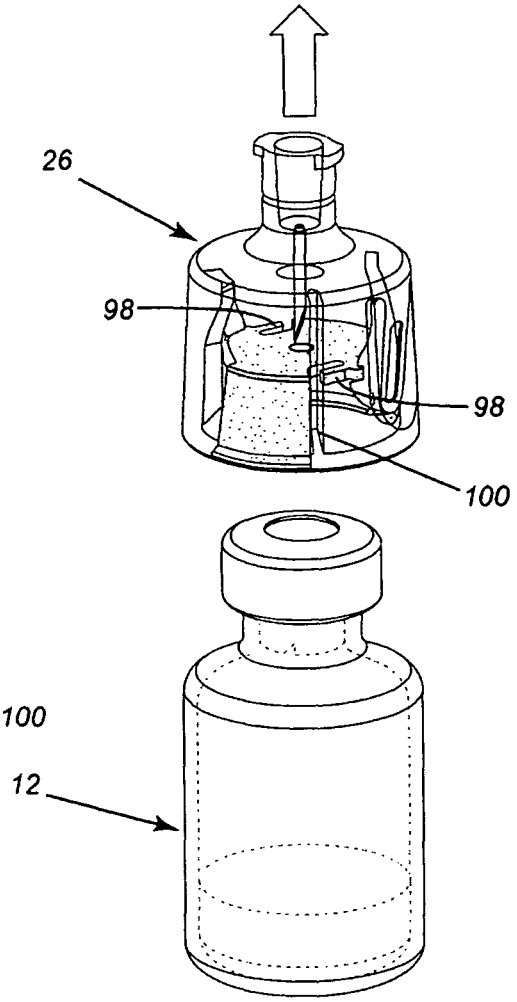

In the embodiment of FIGS. 18 to 19D, it will be noted that top wall 42 is provided with protrusions 96 and locking latches 98. On the interior there are provided ribs 100 and angled side wall portions 102. The arrangement is such that upon upward movement of moveable member 94, protrusions 96 engage with angled side wall 102 to rotate moveable member 40. Upon withdrawal, locking latches 98 engage with rib 100 so as to prevent further use of the transfer member.

We claim:

1. A transfer device comprising:

a housing (24) having a top, a side wall (26), said side wall (26) having ribs (90) formed on an interior surface thereof, said ribs defining a groove (92), said side wall having diametrically opposed openings formed therein., an open bottom, said open bottom permitting insertion of a vial (12) within said housing;

a piercing member (34) mounted within said housing (24), said piercing member (34) having a piercing tip (36) located at a bottom end thereof, said piercing member having an interior passageway formed therein;

a connector (30) located on an exterior side of said top;

a moveable member (40) mounted within said housing (24), said moveable member (40) having a substantially circular top wall, a fixed sized aperture formed in said top wall, said fixed sized aperture being sized to prevent a finger accessing said piercing member, downwardly extending legs (87) from said substantially circular top wall, a pair of said downwardly extending legs (87) having buttons (88) formed on an exterior surface thereof, said buttons being designed to engage in said openings (86) in said housing side wall, said moveable member (40) being moveable from a first position wherein said moveable member (40) prevents access to said piercing tip (36) and a second position permitting access to said piercing tip when said vial is inserted in said housing, said top wall of said moveable member engaging said grooves in said housing side wall when said vial is removed.

2. The transfer device of claim 1 wherein said piercing member is selected from the group consisting of a needle or spike.

3. The transfer device of claim 1 wherein said connector (30) on the exterior side of said top comprises a luer connector.

4. The transfer device of claim 1 wherein said piercing member is selected from the group consisting of a needle and a spike.

5. A transfer device comprising:

a housing having a top, a housing side wall, an open bottom, said open bottom permitting insertion of a vial within said housing, a plurality of protrusions formed on said housing side wall;

a piercing member mounted within said housing, said piercing member having a piercing tip located at the bottom end thereof, said piercing member having an interior passageway formed therein;

a connector located on an exterior side of said top;

a moveable member mounted within said housing, said moveable member having a plurality of rib like protrusions formed on an inner wall thereof, at least one of said rib like protrusions having a side wall, said side wall being substantially vertical at a lower portion thereof, said side wall extending diagonally at an upper portion thereof, a top wall being substantially circular in configuration, said top wall having a pair of locking latches formed therein, said locking latches being formed as legs, said legs being flexible, said legs being arranged such that upward movement of said moveable member will cause said moveable member to rotate, said rotation causing said latches to engage with said rib-like protrusions to prevent further use of the transfer device.

6. The transfer device of claim 5 wherein said connector on the exterior side of said top comprises a luer connector.

* * * * *